US005519470A

United States Patent [19]

Corrigan, Jr.

[11] Patent Number: 5,519,470

[45] Date of Patent: May 21, 1996

[54] CROSS MIXING PADDLE WHEEL

[75] Inventor: Richard W. Corrigan, Jr., Webster, N.Y.

[73] Assignee: Xerox Corporation, Stamford, Conn.

[21] Appl. No.: 205,460

[22] Filed: Mar. 4, 1994

[51] Int. Cl.[6] ..... G03G 15/08

[52] U.S. Cl. ..... 355/245; 366/325.3

[58] Field of Search ..... 355/245, 251; 118/653, 657; 366/319, 327, 329, 330, 325.3, 327.1, 329.1, 330.1, 291

[56] References Cited

U.S. PATENT DOCUMENTS

| | | | |
|---|---|---|---|
| 340,082 | 1/1862 | Westcot | 366/329 X |
| 1,013,612 | 1/1912 | Peters | 366/330.1 X |
| 2,735,662 | 2/1956 | Wickland | 366/291 X |
| 3,943,887 | 3/1976 | Smith | 118/637 |
| 3,947,107 | 3/1976 | Smith | 355/3 DD |
| 4,128,052 | 12/1978 | Mueller et al. | 366/330.1 X |
| 4,187,030 | 2/1980 | Godley | 366/319 |
| 4,819,031 | 4/1989 | Thayer et al. | 355/15 |
| 4,855,783 | 8/1989 | Takashima | 355/245 Y |
| 4,959,690 | 9/1990 | Trainor et al. | 355/245 |
| 4,978,997 | 12/1990 | Bell | 355/253 |
| 4,980,724 | 12/1990 | Tanaka | 355/245 |
| 4,982,238 | 1/1991 | Davidson | 355/245 |
| 4,989,539 | 2/1991 | Ichikawa | 355/251 Y |
| 4,996,565 | 2/1991 | Herley | 355/245 |
| 5,016,053 | 5/1991 | Ibuchi et al. | 355/245 |

*Primary Examiner*—Joan H. Pendegrass
*Attorney, Agent, or Firm*—John S. Wagley

[57] ABSTRACT

An auger for mixing particles comprises an elongated member and a first set of fins extending radially outwardly from the elongated member. The auger also comprises a second set of fins extending radially outwardly from the elongated member. The second set of fins defines a spiral so that the particles move radially and longitudinally relative to the elongated member.

19 Claims, 5 Drawing Sheets

CROSS MIXING PADDLE WHEEL

CROSS MIXING PADDLE WHEEL

The present invention relates to a method and apparatus for transporting and cross mixing toner. More specifically, the invention relates to a cross mixing paddle wheel for transporting and cross mixing toner.

The features of the present invention are useful in the printing arts and more particularly in electrophotographic printing. In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner to the latent image at a controlled rate so that the toner effectively adheres electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which typically are comprised primarily of ferrous material. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

When utilizing two component development, the toner particles are attracted by the latent image, transferred to the copy paper and thereby consumed. The carrier particles, on the other hand, are not so attracted and return to the developer sump. The consumed toner must thereby be replaced. The electrophotographic printer thus includes a refillable or replaceable toner container from which additional toner particles are regularly added to the developer unit. The replacement toner must be regularly mixed with the carrier particles in order that the toner particles triboelectrically adhere to the carrier particles to form a magnetic brush as described above.

A mixing apparatus, usually in the form of an auger or augers, is typically added to the development sump to constantly mix the newly added toner particles to the developer material. The auger also serves to agitate the toner particles and carrier beads to assist the triboelectric charging thereof. Typical augers have a spiral screw type configuration with left hand and right hand spiral portions. An alternative prior art auger is in the form of a wobble plate. The wobble plate comprises a series of parallel plates skewed to the axis of the auger at varied angles. As a screw type or wobble plate auger rotates a dead volume occurs along the axis of the auger. Only minimal mixing and agitation occurs in the dead volume causing the auger to provide poor mixing and agitation. Further, these augers require a torque to rotate them that varies with the rotational position of auger. The varying torque causes excessive wear on the drive mechanism for the augers. The sections of the auger with right and left hand spirals or varying angles only provide limited mixing and agitation and may not equally distribute the developer material.

The following disclosures may be relevant to various aspects of the present invention:

U.S. application No. 4,996,565 Patentee: Herley Issue Date: Feb. 26, 1991

U.S. application No. 4,982,238 Patentee: Davidson Issue Date: Jan. 1, 1991

U.S. application No. 4,980,724 Patentee: Tanaka Issue Date: Dec. 25, 1990

U.S. application No. 4,978,997 Patentee: Bell Issue Date: Dec. 18, 1990

U.S. application No. 4,819,031 Patentee: Thayer et al. Issue Date: Apr. 4, 1989

U.S. application No. 4,187,030 Patentee: Godley Issue Date: Feb. 5, 1980

U.S. application No. 3,947,107 Patentee: Smith Issue Date: Mar. 30, 1976

U.S. application No. 3,943,887 Patentee: Smith Issue Date: Mar. 16, 1976

U.S. application No. 4,996,565 discloses an apparatus which mixes developer material in the chamber of a developer housing a pair of augers transports the developer material in a recirculating path from one region of the chamber to another region. A generally planar member is interposed between the augers to separate the augers from one another. The planar member has an aperture in at least one marginal region configured to allow developer to gently move between the first auger and the second auger and being adapted to reduce back up of the developer material and flow unevenness.

U.S. application No. 4,982,238 discloses an auger for transporting the development material to a loading zone where the developer material is received by another auger in the developing chamber. The auger in the developing chamber advances the developer material to a transport roll, which in turn, moves the developer material to a developer roll. The developer roll transports the developer material closely adjacent to the photoconductive member having the electrostatic latent image recorded thereon.

U.S. application No. 4,980,724 discloses an apparatus which mixes developer material in the chamber of a developer housing. An auger transports the developer material in an axial direction from one region of chamber to another region thereof. In addition, as the developer material is being advanced in the axial direction, it is being moved in a radial direction substantially perpendicular to the axial direction of movement. In this way, the charge characteristics of the developer material are provided.

U.S. application No. 4,978,997 discloses a development system for a reproduction machine which includes a pair of augers which mix and transfer the developer mixture to a magnetic roll brush system. The supply auger is positioned in a horizontal plane. The second return auger is at an angle to the first auger. The first auger transports developer material in one direction mixing the developer material and dispensing developer material along its length by gravity to the magnetic brush roll sump. A developer material transport opening at one end allows developer material to be gravity fed to the adjacent end of the inclined auger which carries the developer material uphill. The developer material is transferred at the other end by gravity feed back to the first auger.

U.S. application No. 4,819,031 discloses a toner removal device for removing toner and debris from a charge retentive surface after transfer of toner images from the surface. This device is characterized by an integral extruded multi-vaned tone transport member for vertical removal of toner accumulated at a cleaning blade chiselingly removing toner from the charge retentive surface and transporting toner from the area about the blade to a augering transport device for transporting toner to a sump.

U.S. application No. 4,187,030 discloses an interlocking auger-mixer mechanism especially adapted to transport and mix developer compositions containing toner, or similar materials, prior to the feeding of such materials through an output port in the operation of a xerographic copying machine. The mechanism includes a plurality of fins sections having primary and secondary fins wound in reverse helical directions.

U.S. application No. 3,947,107 discloses an active cross-mixer comprising a pair of rotatably driven augers and a baffle for partially submerging the augers in developer. The crossmixer is mounted in the development system of an electrostatic processor above the sump in a position to intercept the developer returning from the development zone and any additional toner added to maintain the toner concentration at a suitable high level. The developer is divided between the augers which, in turn, laterally transport the developer in opposite directions. Preferably, the baffle is apertured so that developer not only flows over the ends of the baffle but also through the baffle, thereby distributing the developer across the full width of the sump.

U.S. application No. 3,943,887 discloses a hybrid cross-mixer comprising an auger-type active section and a pair of baffle type passive sections. The cross mixer is used in a magnetic brush development system on the downstream side of the development zone. In that event, the partially denuded developer exiting from the developer zone is split, with approximately half being routed to the active section and the other half being more or less equally divided between the two passive sections.

In accordance with one aspect of the present invention, there is provided an auger for mixing particles. The auger comprises an elongated member and a first set of fins extending radially outwardly from the elongated member. The auger also comprises a second set of fins extending radially outwardly from the elongated member. The second set of fins defines a spiral so that the particles move radially and longitudinally relative to the elongated member.

In accordance with another aspect of the present invention, there is provided a developer unit for developing a latent image recorded on an image receiving member. The developer unit comprises an elongated member and a first set of fins extending radially outwardly from the elongated member. The developer unit also comprises a second set of fins extending radially outwardly from the elongated member. The second set of fins defines a spiral so that the particles move radially and longitudinally relative to the elongated member.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 8:
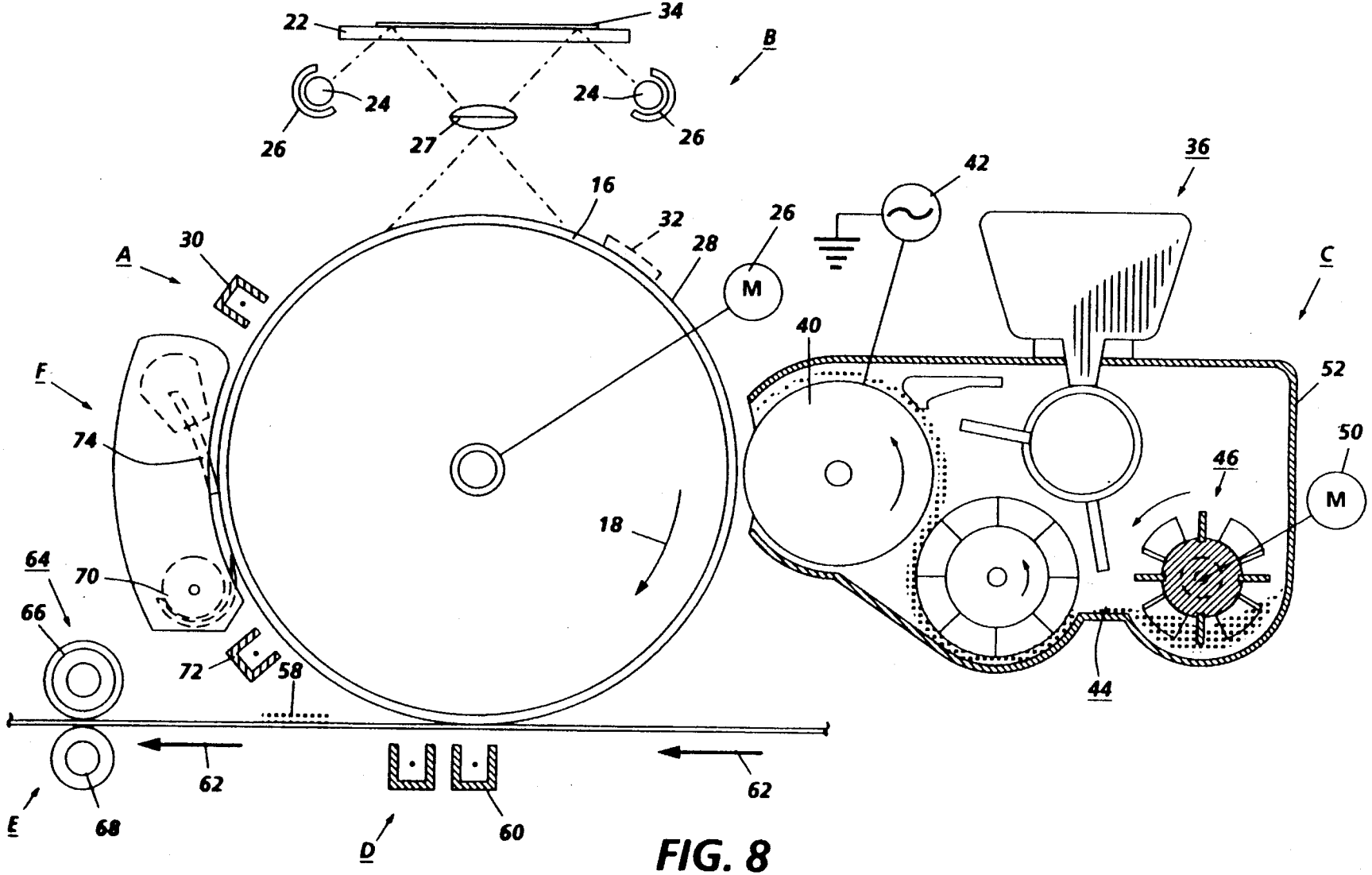
FIG. 8 is a schematic elevational view of an illustrative electrophotographic printing machine incorporating the cross mix auger of the present invention therein.

For a general understanding of the illustrative electrophotographic printing machine incorporating the features of the present invention therein, reference is made to the drawings. In the drawings, like reference numerals have been used throughout to designate identical elements. FIG. 8 schematically depicts the various components of an electrophotographic printing machine incorporating the premetering device of the present invention therein. Although the premetering devices of the present invention are particularly well adapted for use in the illustrative printing machine, it will become evident that these premetering devices are equally well suited for use in a wide variety of printing machines and are not necessarily limited in their application to the particular embodiments shown herein.

Referring now to FIG. 8, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the drum 16 by a system of mirrors 26 and lens 27, as shown. The optical image selectively discharges surface 28 of the drum 16 in an image configuration whereby an electrostatic latent image 32 of the original document is recorded on the drum 16 at the imaging station B.

At development station C, a magnetic brush development system or unit, indicated generally by the reference numeral 36 advances developer materials into contact with the electrostatic latent images. Preferably, the magnetic developer unit includes a magnetic developer roller mounted in a housing. Thus, developer unit 36 contains a magnetic roller 40. The roller 40 advances developer material into contact with the latent image. Appropriate developer biasing is may be accomplished via power supply 42, electrically connected to developer unit 36.

The developer unit 36, in the direction of movement of drum 16 as indicated by arrow 18, develops the charged image areas of the photoconductive surface. This developer unit contains black developer, for example, material 44 having a triboelectric charge such that the black toner is urged towards charged areas of the latent image by the electrostatic field existing between the photoconductive surface and the electrically biased developer rolls in the developer unit which are connected to the bias power supply 42.

To assist in the mixing of new toner with the developer material 44 in the developer unit 36 and to assist in the triboelectric charging of the developer material 44, the developer unit includes a mixing auger 46. The mixing auger 46 may be located in a lower portion of the unit 36 and extends along the length of the unit 36. The mixing auger 46 may be driven by any suitable means such as by an electrical motor 50, either being directly connected to the motor 50 or indirectly connected with drive elements such as gears or belts. It should also be appreciated that the auger 46 may likewise be driven by motor 26 with appropriate drive elements. The mixing auger 46 is secured to the developing unit in any suitable manner such as by being supported by the developer housing 52.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station F. The cleaning station F includes an electrostatic, fur brush cleaner unit 70 as well as a blade 74. The fur brush cleaner unit 70 rotates at relatively high speeds which creates mechanical forces that tend to sweep the residual toner particles into an air stream, and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
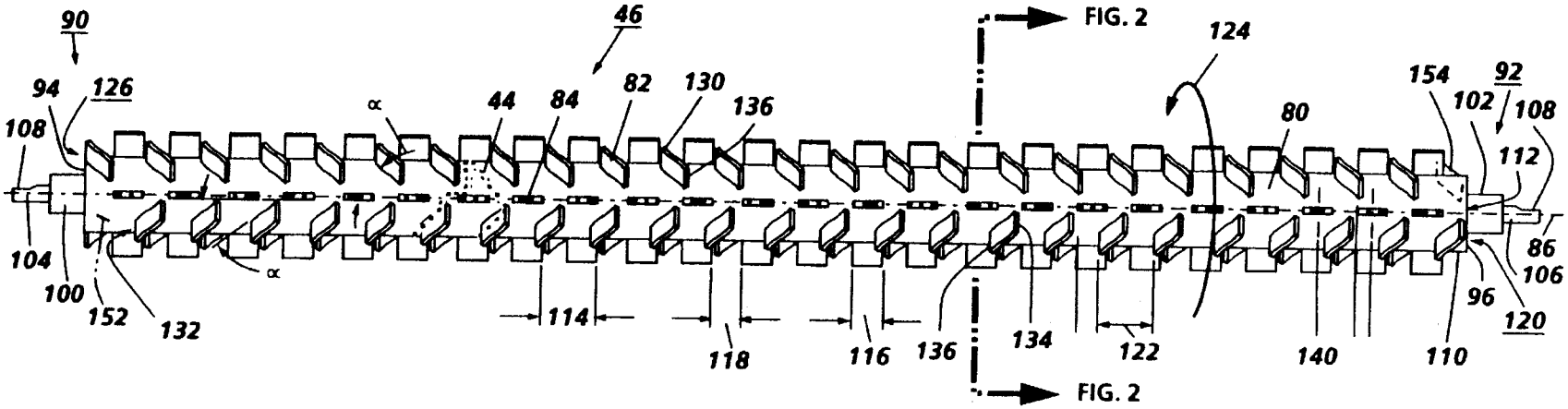
FIG. 1 is a plan view of an embodiment of the cross mix auger of the present invention.

According to the present invention, and referring to FIG. 1, mixing auger 46 is shown. The auger 46 includes an elongated member in the form of a body 80 from which oblique fins 82 and radial fins 84 extend. The body 80 may have any suitable shape, but the form of a cylinder may be particularly well suited for rotating augers. The body 80 extends along the length of the auger 46. The center of the body 80 is defined by an axis 86. To provide drive connecting means and support means for the auger 46, first and second stems 90 and 92, respectively, extend outwardly from first and second ends 94 and 96 of the body 80 of the auger 46. The stems 90 and 92 serve to support and provide a drive connecting means for the auger 46. The stems 90 and 92 are preferably concentric with the body 80 along axis 86. The stems 90 and 92 include larger inboard portions 100 and 102, respectively, and smaller outboard portions 104 and 106, respectively, extending from the inboard portions. The inboard portions 100 and 102 may serve to provide support by serving as journals for bearings (not shown) which may be mounted into developer housing 52 (see FIG. 8). The outboard portions 104 and 106 may serve to provide drive connecting means in conjunction with flats 108 located on the outboard supports 104 and 106 to interconnect with appropriate drive elements (not shown) to drive the auger 46 with the motor 50 (see FIG. 8). It should be appreciated that the stems 90 and 92 may alternatively have a singular cylindrical shape.

Returning again to FIG. 1, the radial fins 84 extend outwardly from the body 80. The radial fins 84 are typically in the form of fins which may have any particular shape, such as in the form of thin, rectangular plates. Several radial fins 84 extend along the periphery 110 of the body 80.

Preferably, the radial fins 84 are positioned in radial fin rows 112. The rows 112 are preferably parallel to axis 86, and the radial fins 84 within a particular radial fin row 112 are preferably coplanar with each other. The fins 84 within the fin row 112 are preferably equally spaced and are so spaced such that similar parts of adjacent fins 84 are separated by a distance defined as a radial fin pitch 114. The pitch 114 is equal to distance 116 between adjacent radial fins 114 plus width 118 of the radial fins 84.

Figure 2:
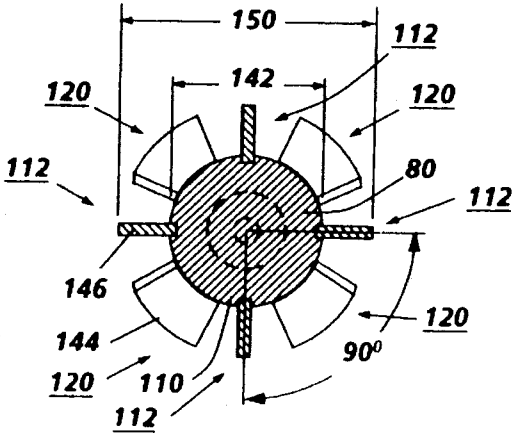
FIG. 2 is a sectional elevational view taken along the line 2—2 in the direction of the arrows of FIG. 1.

Preferably, the auger 46 includes more than one radial fin row 112. Preferably, the radial fin rows 112 are equally angularly spaced about the periphery 110 of the auger 46. The auger 46 of FIG. 1, for example, includes four radial fin rows 112 as shown in FIG. 2. These four radial fin rows 112 are spaced approximately 90 degrees apart from each other.

Referring again to FIG. 1, the auger 46 also includes the oblique fins 82 in the form of oblique fins 82. The oblique fins 82 may have any suitable configuration, such as in the form of a thin plate, with a rectangular shape. The oblique fins 82 and the axis 86 form an oblique fin angle $\alpha$ therebetween. While each of the oblique fins 82 may have a unique oblique fin angle $\alpha$, preferably, each of the oblique fins 82 has a similar oblique fin angle $\alpha$.

Preferably, several of the oblique fins 82 are positioned in a row parallel to the axis 86 along the periphery 110 of the auger 86 to form an oblique fin row 120. The oblique fins 82 in the oblique fin row 120 form a set of fins which defines a spiral about periphery 110 of the auger 46. The spiral moves material or particles 44 radially and longitudinally relative to body 80 of auger 46. Preferably, the oblique fins 82 in the oblique fin rows 120 are equally spaced with similar portions of adjacent oblique fins 82 being separated by a distance defined as an oblique fin pitch 122. Preferably, the oblique fin pitch 122 is similar to the radial fin pitch 114 of the radial rows 112.

Preferably, the auger 46 includes more than one oblique fin row 120. As shown in the embodiment of FIG. 1, the auger 46 includes four oblique fin rows 120 equally spaced about the periphery 110 of the auger 46 as shown in FIG. 2. Preferably, the oblique fin rows 120 are equally angularly spaced between the radial fin rows 112. It should be readily appreciated that while the auger 46 of FIG. 1 includes four radial fin rows 112 and four oblique fin rows 120, the invention may be equally practiced with a smaller or larger equal number of radial and oblique fin rows, 112 and 120, respectively. For example, the auger may include three radial fin rows and three oblique fin rows, or six radial fin rows and six oblique fin rows.

Preferably, the radial fins 84 within each radial fin row 112 are axially aligned with a corresponding radial fin 84 in each of the other radial fin rows 112. Preferably, each of the oblique fins 82 in each of the oblique fin rows 120 has a correspondingly similarly radially positioned oblique fin 82 in each of the other of the oblique fin rows 120. Adjacent oblique fin rows 120, however, preferably, have oblique fin angles $\alpha$ pointing in different directions. For example, as the auger 46 rotates in the direction of arrow 124, a first oblique fin row 126 has leading edge 130 of the oblique fins 82 pointed toward first end 94 of the auger 46. On the other hand, second oblique row 132 has leading edge 134 of the oblique fins 82 pointed toward the second end 96 of the auger 46. Preferably, trailing edges 136 of the oblique fins 82 are generally axially positioned relative to centerline 140 of the radial fins 84.

Now referring to FIG. 2, the periphery 110 of the body 80 of the auger 46 defines a body diameter 142. Distal faces 144 of the oblique fins 82 and distal faces 146 of the radial fins 84 define an auger diameter 150. The relative size of the body diameter 142 with respect to the auger diameter 150 may affect the effectiveness of the auger 46. A body diameter 142 of approximately half the auger diameter 150 may be suitable.

While the oblique fins 82 and the radial fins 84 may generally have rectangular shapes, the distal faces 144 and 146 of the fins 82 and 84, respectively, may have an arcuate shape corresponding to and conforming to the auger diameter 150. The auger 46 may be made of any suitable durable material such as a metal or plastic, and may be molded of a durable plastic material.

Again referring to FIG. 1, preferably, the auger 46 has the leading edges 130 and 134 of the oblique fins 82 located adjacent first and second ends 94 and 96, respectively, of the body 80. Oblique fins 82 for which the trailing edge 136 of the oblique fins 82 would be adjacent the first and second ends 94 and 96, respectively, are removed from the auger 46, their absence being apparent in zones 152 and 154 near the first and second ends 94 and 96, respectively.

Figure 3:
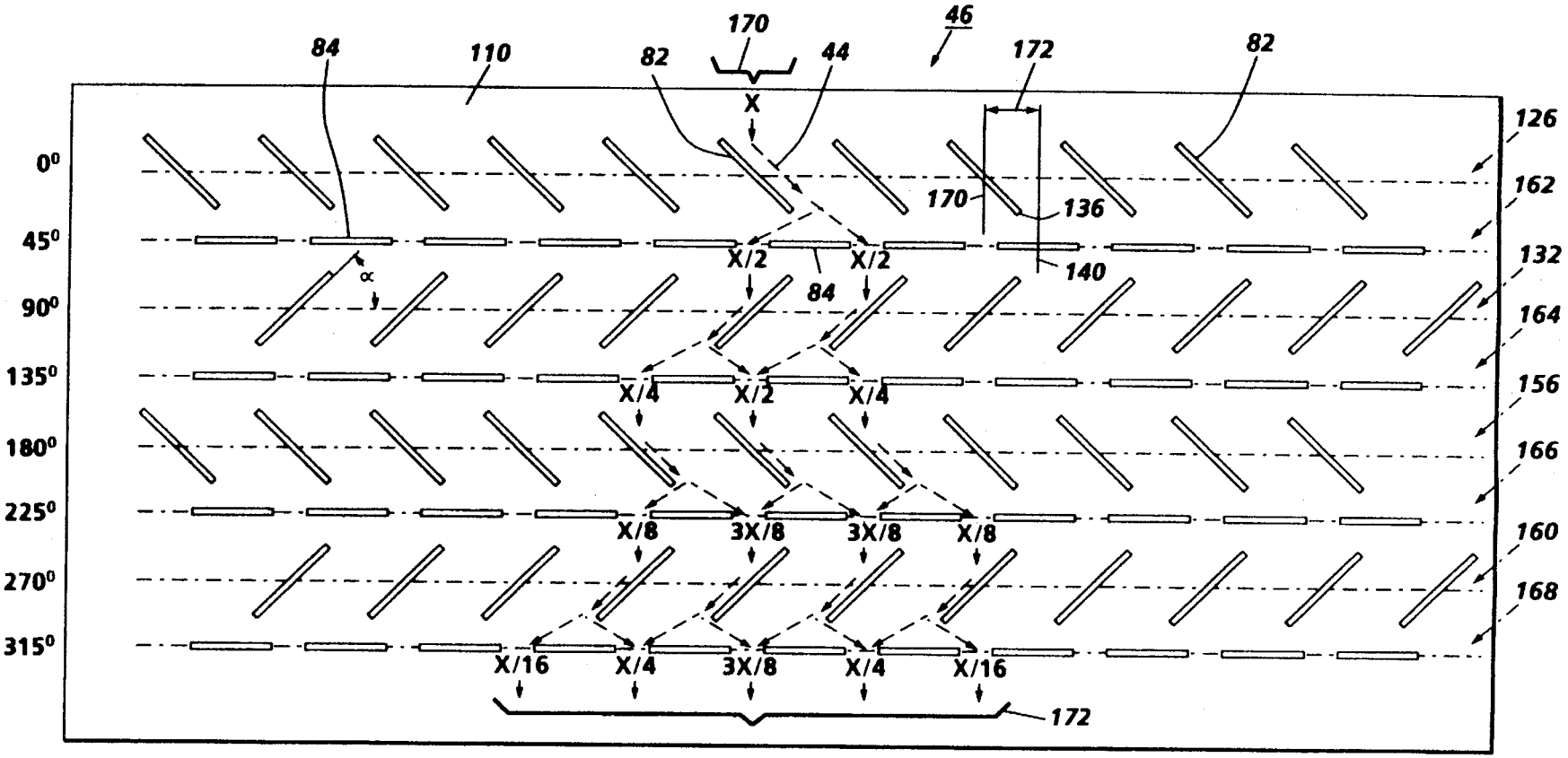
FIG. 3 is a layout of the periphery of the cross mix auger of FIG. 1 showing the location of the fins around the periphery of the auger.

Referring now to FIG. 3, the flow of developer material 44 through the oblique fins 82 and the radial fins 84 is shown. The oblique fins 82 and the radial fins 84 are equally spaced about periphery 110 of the auger 46. The oblique fins 82 are equally spaced in first oblique fin row 126, second oblique fin row 132, third oblique fin row 156, and fourth oblique fin row 160. First and third oblique fin rows 132 and 156, respectively, are identical, while second and fourth oblique fin rows 126 and 160, respectively, are also identical. The oblique fins 82 in the first oblique fin row 126 have the oblique fin angle $\alpha$ pointing upward and to the left, while the second oblique fin row 132 has the oblique fin angle $\alpha$ pointing upwardly and to the right. First radial fin row 162, second radial fin row 164, third radial fin row 166 and fourth radial fin row 168 are all identical. Preferably, centerline 170 of the oblique fins 82 is offset by a distance 172 from the centerline 140 of the radial fins 84, such that trailing edge 136 of the oblique fins 82 is positioned somewhat near the centerline 140 of the radial fins 84. Preferably, the trailing edge 136 is slightly to the left of the centerline 140.

To demonstrate the operation of the auger 46, a finite amount X of developer material 44 enters the augers 46 at inlet position 170. An oblique fin 82 within the first oblique row 126 diverts the developer material 44 downwardly and to the right toward a radial fin 84 on the first radial fin row 162. The quantity X of developer material 44 impinging upon the radial fin 84 splits into developer material quantity X/2 and X/2 which moves between adjacent radial fins 84 of the first radial fin row 162. The two separate streams X/2 of the developer material 44 enter the second oblique row 132, each stream X/2 impinging on one of two adjoining oblique fins 82 of the second oblique row 132. Each of the streams X/2 travel downwardly and to the left toward adjoining radial fins 84 in the second radial fin row 164. One half of quantity X or X/2 passes between the radial fins 84 in the second radial fin row 164 with which the stream X/2 impinged, while X/4 and X/4 of the developer material pass outside these adjacent radial fins 84. Therefore, the portions X/2, X/4, and X/4 of developer material 44 passing through the second developer row 164 impinge onto the third oblique fin row 156 where they are directed downwardly and to the right toward three adjacent radial fins 84 on the third radial fin row 166. The portions X/2, X/4, and X/4 of developer material impinging on the three adjacent radial fins 84 in the third radial fin row 166 are divided into four distinct portions, X/8, 3X/8, 3X/8, and X/8. The portions X/8, 3X/8, 3X/8, and X/8 of developer material 44 from the third radial fin row 166 impinge on four adjacent oblique fins 82 on the fourth oblique fin row 160 where it is further directed downwardly and to the left toward four adjacent radial fins 84 on the fourth radial fin row 168. The fourth radial fin row 168 further divides the portions X/8, 3X/8, 3X/8, and X/8 of developer material 44 into portions X/16, X/4, 3X/8, X/4 and X/16 which form output 172. It should be appreciated that the amount X of developer material 44 entering the auger 46 at the first oblique row 126 is only exemplary of the movement of developer material 44 through the cross mix auger 46. The dividing of the developer material 44 occurs simultaneously at all positions of the auger 46 and thus quickly and efficiently distributes the developer material about the developer housing 36 (see FIG. 8).

Figure 4:
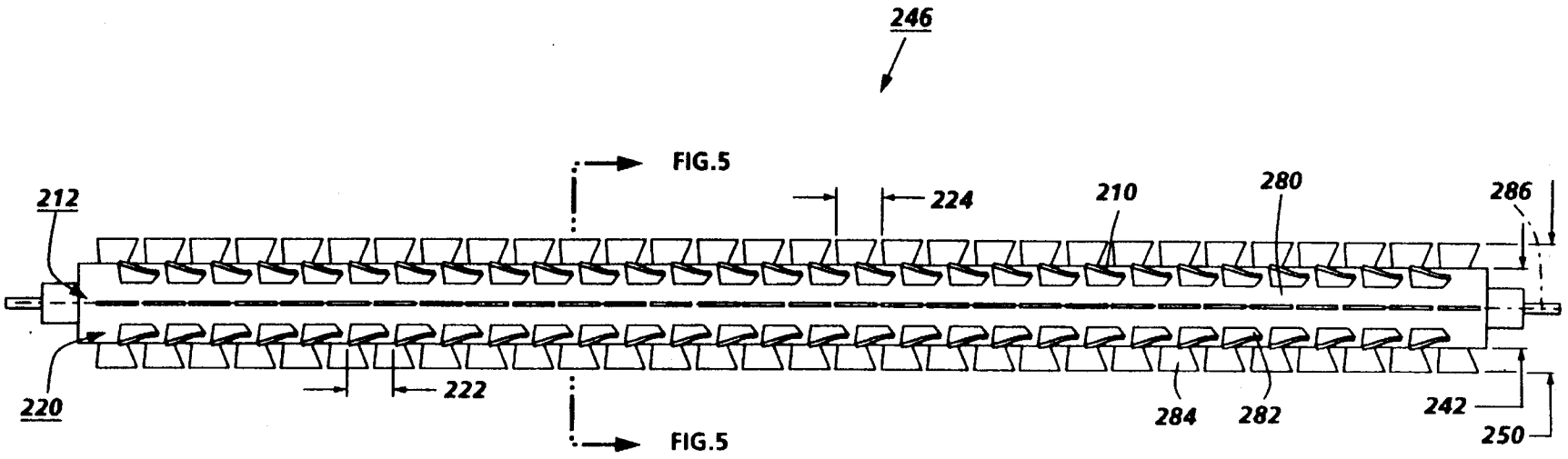
FIG. 4 is a plan view of an alternate embodiment of the cross mix auger of the present invention.

Now referring to FIG. 4, an alternate embodiment of the invention is shown in cross mix auger 246. Cross mix auger 246 is similar to auger 46 of FIG. 1. Auger 246 includes a body 280 from which radial fins 284 and oblique fins 282 extend. The equally spaced radial fins 284 are located in radial fin rows 212 while the equally spaced oblique fins 282 are located around the body 280 in oblique fin rows 220. Adjacent oblique fins 282 are separated a distance defined as an oblique fin pitch 222 while adjacent radial fins 284 are separated a distance defined as a radial fin pitch 224. Preferably, the radial fin pitch 224 and the oblique fin pitch 222 are similar. Periphery 210 of the body 280 of the auger 246 defines a body diameter 242.

Figure 5:
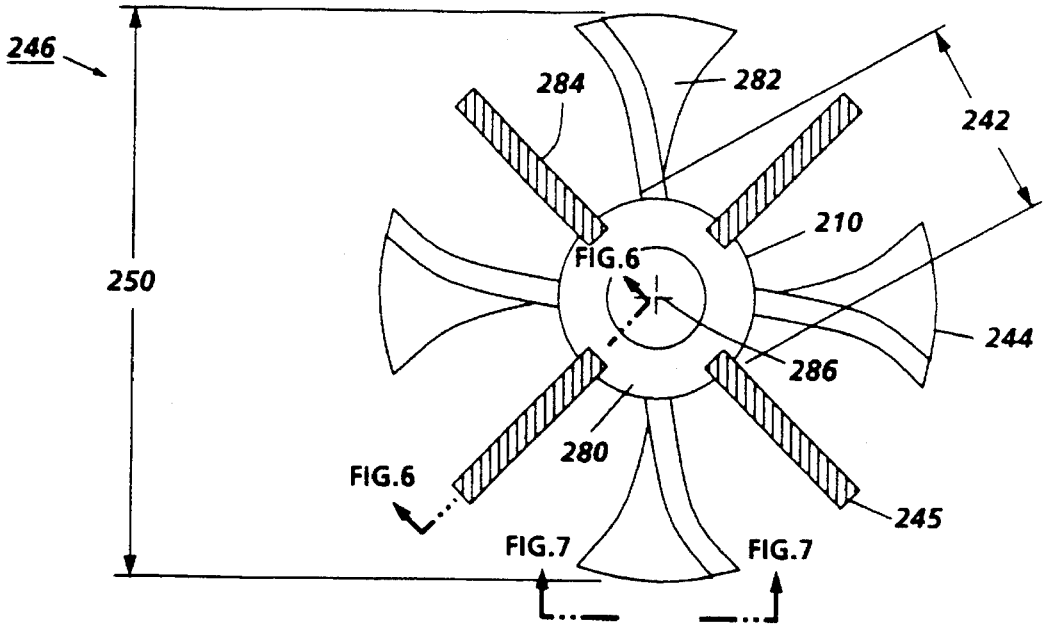
FIG. 5 is a sectional elevational view taken along the line 5—5 in the direction of the arrows of FIG. 4.

The radial fin rows 212 and oblique fin rows 220 are spaced about the periphery 210 of the auger 246 in a configuration similar to that of FIG. 3 for the auger 46 (see FIGS. 4 and 5). Therefore, the developer material is likewise split as it progresses through the auger 246 in a manner similar to that of auger 46.

Now referring to FIG. 5, the auger 246 preferably has a generally equal number of radial fins 284 and oblique fins 282. The oblique fins 282 and the radial fins 284 are equally angularly spaced about axis 286 of the auger 246. An oblique fin distal face 244 and a radial fin distal face 245 define an auger diameter 250. Preferably, as in the auger 46 of FIG. 1, the body diameter 242 is approximately one half of the auger diameter 250.

Figure 6:
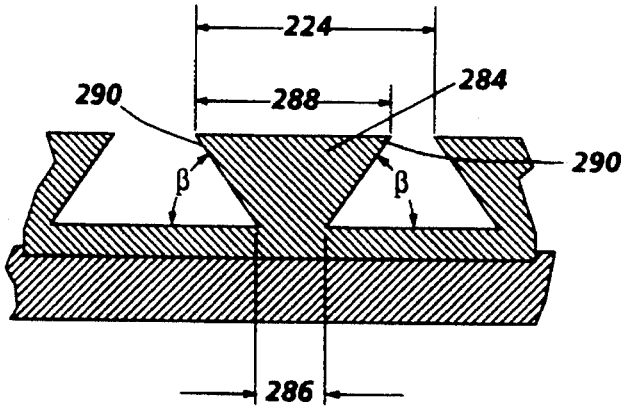
FIG. 6 is a sectional elevational view taken along the line 6—6 in the direction of the arrows of FIG. 5.

Now referring to FIG. 6, the radial fins 284, unlike the radial fins 84 of the auger 46 of FIG. 1, have a plate-like configuration with a trapezoidal shape. It should be appreciated, however, that the shape of the radial fins 284 may have other shapes including a rectangular shape. The radial fins 284 have a body peripheral width 287 which is smaller than a radial fin distal face width 288. Oblique faces 290 of the radial fin 284 form an angle $\beta$ with the axis 286 of the auger 264 (see FIG. 4).

Figure 7:
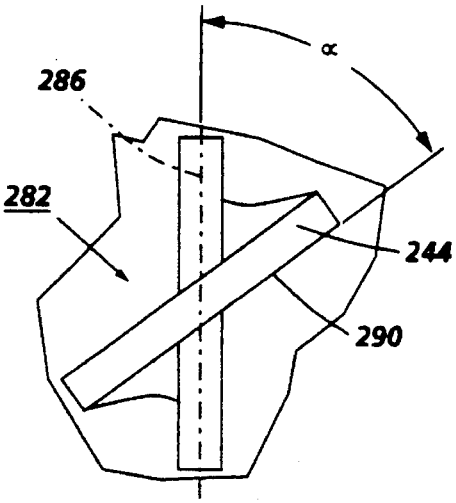
FIG. 7 is a partial sectional elevational view along the line 7—7 in the direction of the arrows of FIG. 6.

Now referring to FIG. 7, the oblique fins 282 have a configuration similar to the configuration of radial fins 284 as shown in FIG. 6, except that the oblique fin 282 is twisted adjacent the oblique fin distal face 244 such that face 290 of oblique fin 282 forms an oblique fin angle $\alpha$ with respect to axis 286 of the auger 246. It should be appreciated that the trapezoidal shape of the fins 282 makes the twisting of the fin 282 easier to accomplish.

The auger 246 may be constructed of any suitable material and may, for example, be manufactured from a metal body 280 and have flexible fins welded therefrom in order to form the fins 282 and 284. The auger 246 may likewise be molded from a plastic material.

The use of an auger that contains a body centrally located about the axis of rotation of the auger prevents developer material from occupying a position at or near the center of rotation of the auger. The auger at its periphery and outwardly therefrom thus has a significant translational speed so that the developer material will be significantly displaced anywhere about the auger. This configuration thus eliminates dead spots of uncirculated developer material at the axis of the auger.

The use of outwardly pointing oblique fins near the ends of the body of the auger draws developer material from the walls of the developer housing thus avoiding uncirculated developer material at these walls and the consequential caking of developer material in those areas.

The placement of alternating rows of oblique fins and radial fins equally spaced about the periphery of the auger, having adjacent oblique rows with fins pointed in opposite direction, as well as, having the discharge of the oblique fins in alignment with the radial fins provides a superior dispersion of the developer material about the periphery of the auger, thus optimizing mixing of the developer material. Also, the motion of the developer material between the oblique and radial fins causes the developer material to dance around the periphery of the auger providing collisions of the developer particles in the air surrounding the auger thereby improving the triboelectric charging of the developer material.

The use of a multitude of fins each having a small cross section and each being equally spaced about the auger provides for an auger which when driven causes a very steady electrical draw upon the motor which propels the auger. Thus, the high frequency component of the motor which drives the auger is much less than it would be with prior art cross mixing augers. This auger, thus, would require lower torque and less power to so drive it, thus permitting the use of smaller, less expensive, and less power consuming motors.

The auger of this invention will serve equally as well where the developer housing utilizes color or black developer. The use of the small, highly effective and low power consuming auger may, in fact, be particularly well suited in those color xerographic machines which may require several developer sumps, each having its own cross mixing auger.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An auger for mixing particles, comprising:

an elongated member;

a first set of fins extending radially outwardly from said elongated member; and a second set of fins extending radially outwardly from said elongated member and spaced from said first set of fins, at least a portion of said fins of said second set of fins defining a spiral so that the particles move radially and longitudinally relative to said elongated member substantially along the length of said elongated member, wherein said second set of fins comprises a plurality of fins arranged to form a row of spaced apart fins having a first portion of said fins of said second set of fins substantially parallel to said elongated member and a second portion of said fins of said second set of fins oblique to said elongated member.

2. An auger according to claim 1, wherein said first set of fins comprise a plurality of spaced apart fins substantially co-linearly arranged and substantially parallel to said elongated member.

3. An auger according to claim 2, wherein said fins of said first set of fins and said fins of said second set of fins are alternately and substantially equally spaced about said elongated member.

4. An auger according to claim 3, wherein said fins of said first set of fins and said fins of said second set of fins adjacent one another are staggered.

5. An auger according to claim 4, wherein said fins of said second set of fins are helically shaped.

6. An auger according to claim 5, wherein said elongated member comprises a cylinder.

7. A developer unit for developing a latent image recorded on an image receiving member, comprising:

an elongated member;

a first set of fins extending radially outwardly from said elongated member; and a second set of fins extending radially outwardly from said elongated member and spaced from said first set of fins, at least a portion of said fins of said second set of fins defining a spiral so that the particles move radially and longitudinally relative to said elongated member substantially along the length of said elongated member.

8. A developer unit according to claim 7, wherein said second set of fins comprises a plurality of fins arranged to form a row of spaced apart fins having a first portion of said fins of said second set of fins substantially parallel to said elongated member and a second portion of said fins of said second set of fins oblique to said elongated member.

9. A developer unit according to claim 8, wherein said first set of fins comprise a plurality of spaced apart fins substantially co-linearly arranged and substantially parallel to said elongated member.

10. A developer unit according to claim 9, wherein said fins of said first set of fins and said fins of said second set of fins are alternately and substantially equally spaced about said elongated member.

11. A developer unit according to claim 10, wherein said fins of said first set of fins and said fins of said second set of fins adjacent one another are staggered.

12. A developer unit according to claim 11, wherein said fins of said second set of fins are helically shaped.

13. A developer unit according to claim 12, wherein said elongated member comprises a cylinder.

14. An auger for mixing particles, comprising:

an elongated member;

a first set of fins extending radially outwardly from said elongated member; and a second set of fins extending radially outwardly from said elongated member, at least a portion of said fins of said second set of fins defining a spiral so that the particles are guided by the fins to form streams of particles which move radially and longitudinally relative to said elongated member, at least one of said fins of said first set of fins positioned relative to at least one of said fins of said second set of fins so as to divide a stream of particles from one of said fins of said first set of fins into two discrete streams of particles when the stream of particles contacts said fin of said first set of fins.

15. An auger according to claim 14, wherein said second set of fins comprises a plurality of fins arranged to form a row of spaced apart fins having a first portion of said fins of said second set of fins substantially parallel to said elongated member and a second portion of said fins of said second set of fins oblique to said elongated member.

16. An auger according to claim 15, wherein said first set of fins comprise a plurality of spaced apart fins substantially co-linearly arranged and substantially parallel to said elongated member.

17. An auger according to claim 16, wherein said fins of said first set of fins and said fins of said second set of fins are alternately and substantially equally spaced about said elongated member.

18. An auger according to claim 17, wherein said fins of said first set of fins and said fins of said second set of fins adjacent one another are staggered.

19. An auger according to claim 18, wherein said fins of said second set of fins are helically shaped.

* * * * *